United States Patent [19]

Black

[11] Patent Number: 4,754,609

[45] Date of Patent: Jul. 5, 1988

[54] HIGH EFFICIENCY METHOD AND APPARATUS FOR MAKING AND DISPENSING COLD CARBONATED WATER

[75] Inventor: William J. Black, Coon Rapids, Minn.

[73] Assignee: The Cornelius Company, Anoka, Minn.

[21] Appl. No.: 96,982

[22] Filed: Sep. 14, 1987

Related U.S. Application Data

[63] Continuation of Ser. No. 912,284, Sep. 29, 1986, abandoned.

[51] Int. Cl.[4] ..... F25D 3/00

[52] U.S. Cl. ..... 62/59; 62/200; 62/306; 62/394; 62/399

[58] Field of Search ..... 62/59, 199, 200, 389, 62/394, 396, 398, 399, 306; 222/146.6

[56] References Cited

U.S. PATENT DOCUMENTS

| | | | |
|---|---|---|---|
| 2,237,261 | 4/1941 | McGrath | 62/200 |
| 2,461,760 | 2/1949 | Newton | 62/200 X |
| 2,463,899 | 3/1949 | Nicholas | 62/396 X |
| 3,608,779 | 9/1971 | Cornelius | 222/54 |
| 3,926,342 | 12/1975 | Selvia et al. | 222/146.6 X |
| 4,008,832 | 2/1977 | Rodth | 62/399 X |
| 4,476,690 | 10/1984 | Ianelli | 62/59 X |
| 4,565,072 | 1/1986 | Fujiwara et al. | 62/200 X |

*Primary Examiner*—William E. Tapolcai
*Attorney, Agent, or Firm*—Henry C. Kovar

[57] ABSTRACT

A method of and apparatus for making, cooling and dispensing carbonated water or beverage wherein the method has the steps of providing a single supply of condensed refrigerant, discretely routing a first portion of the refrigerant to a precooler and precooling the water only to an intermediate moderate temperature of about 40 degrees F. (5 degrees C.) with the first refrigerant portion, carbonating the water before or after precooling, transferring the precooled and carbonated water to a final cooler of the ice bank type and final cooling the carbonated water and syrup to as close to 32 degrees F. (0 degrees C.) as is possible, and discretely routing a second portion of refrigerant to the ice bank. The discrete flow of refrigerant to the precooler and the discrete flow of refrigerant to the ice bank final cooler are each discretely controlled and portioned and routed, with this method and apparatus having extremely high efficiency and making very cold carbonated water reliably and without freeze ups. The apparatus has a refrigeration high side with a compressor, a water conduit to a plurality of dispensing valves, a precooler, a first refrigerant branch to the precooler and with a discrete refrigerant supply and portioning valve structure, a final cooler of the ice bank type, a second refrigerant branch to the final cooler and with a discrete refrigerant supply and portioning valve structure, a compressor control structure that runs the compressor when either the precooler or the final cooler requests for refrigerant, a priority device which gives the precooler exclusive priority to all of the refrigerant supply, and a syrup conduit through the final cooler.

41 Claims, 2 Drawing Sheets

WATER
P
V
CO2
12
14
16
10
18
20
22
24
26
28
30
32
34
36
38
40
42
44
46
48
50
52
54
56
58
60
62
64
66
68
70
72
74
76
78
80
82
84
86
88
90
92
94
96

12

20
92
22
24
90
28
94
96
WATER
30
26
P
18
88
32
52
94
28
42
94
14
54
64
62
V
56
38
V
58
48
44
48
50
46
59
60
36B
V
V
84
82
SYRUP
CO2
18
74
76
V
V
V
78
66
36A
80
101
16
70
40
68
72
10A

HIGH EFFICIENCY METHOD AND APPARATUS FOR MAKING AND DISPENSING COLD CARBONATED WATER

This application is a continuation-in-part of Ser. No. 912,284, filed on Sept. 29, 1986, now abandoned.

BACKGROUND OF THE INVENTION

1. Field of the Invention

This invention pertains to a high efficiency method and an apparatus for making, cooling and dispensing carbonated water or beverage utilizing discrete precool and final coolers supplied by a common refrigerant source; the discrete precooler is of very high thermal efficiency and BTU capacity and precools the water only to an intermediate temperature of about 45 degrees F. (7 degrees C.) and an ice bank final cooler final cools the water to as close to freezing as is possible with great accuracy without freeze-up.

THE PRIOR ART

Prior and existing carbonated beverage coolers of high capacity have been devised. They typically have a relatively large compressor and a single evaporator. Some have plural compressors and evaporators.

One type of evaporator system puts the evaporator in direct contact with the water. This is the most efficient of all cooling systems, but this system has suffered from failures due to freeze ups or else the dispensed water has been too warm. The crux of the problem with this type of cooling system is that it cannot be accurately controlled and as the water temperature approaches freezing, and the unit eventually freezes up and becomes plugged with ice or it bursts. In order to avoid these failures, users have set the water temperature higher and the device then dispenses warm drinks which are not acceptable to the soft drink entities or the consuming public. This type of device was fairly popular in the 1940's and 1950's, but has not seen significant use since then because of its history of failure and problems.

Ice bank refrigeration systems are now common and are the most frequently used cooling systems in the cooling and dispensing of carbonated water and soft drinks. A typical ice bank beverage cooler is disclosed in R. T. Cornelius' U.S. Pat. No. 3,056,273. This type of cooler is very accurate and repetitive and it will cool a beverage to very close to freezing (32 degrees F. or 0 degrees C.) reliably and without freeze up. However, the system sacrifices thermal efficiency and its dispensing capacity is limited by the amount of ice it has. This type of unit builds up its ice bank, and uses the inventory of ice to cool beverage. As the ice thickness on the evaporator builds up, the output of the refrigeration system decreases. The response of the refrigeration system to dispensing is slow and there's a considerable time lag before the compressor responds to dispensing and consumption of the ice bank.

Multiple compressor systems are well known and are typically used in semi-frozen drink dispensers. An example is R. T. Cornelius' U.S. Pat. No. 3,608,779. Here, one compressor provides a discrete refrigerant supply for a precooler and a second compressor does the finish cooling of the semi-frozen product. The beverage is cooled well below freezing so there are few problems of control accuracy and/or repeatability.

Split evaporator systems are well known in juice dispensers and a representative system is shown in J. R. McMillin's U.S. Pat. No. 3,898,861. In this type of system, the refrigerant from a single compressor is divided between a juice reservoir and a diluent water cooler. Each divided half of the split system tries to do the entire cooling of its constituent; i.e., concentrate or water, in one step. All of these systems suffer from occasional failure, be it freeze ups or concentrate spoilage.

The type of water refrigeration presently being used by the large retailers of beverages, specifically the fast food stores, is a very large, bulky and expensive ice bank unit that may freeze several hundred pounds of ice in its ice bank. These devices take an inordinate amount of volume within the store. The size of these devices approaches the size of a sub-compact car. These devices have long run times and use quite a bit of electricity.

There is a great need for a physically smaller, higher capacity beverage cooler that weighs less, costs less, and is more efficient and which uses less electricity per unit of produced cold beverage.

OBJECTS OF THE INVENTION

It is an object of the present invention to provide a new improved method of making and dispensing cold carbonated water or beverage with a high efficiency and high BTU output precool and a very accurate final cool with both coolings, being done with refrigerant from a slngle source.

It is an object of the present invention to provide a new improved high efficiency method of making, cooling and dispensing a flow of cold carbonated water or beverage at a temperature just above freezing, with a high capacity and high thermal efficiency precool, and lower capacity but very accurate final cool with both coolings, being discretely done with refrigerant from a common source.

It is an object of the present invention to provide a new improved apparatus for making and dispensing cold carbonated water or beverage with a common source of refrigerant supplying both a high capacity and high thermal efficiency precooler, and a discrete ice bank type final cooler.

It is an object of the present invention to provide a new improved and highly efficient apparatus for cooling and dispensing cold carbonated water or beverage at just above freezing with a discrete high thermal efficiency precooler and a discrete thermally accurate final cooler, both of which are supplied refrigerant from a common source.

SUMMARY OF THE INVENTION

A method of making, cooling, and dispensing cold carbonated water or beverage has the steps of providing a supply of water, providing a single supply of condensed refrigerant gas, discretely precooling the water in a first heat exchanger, routing a first portion of refrigerant over the first heat exchanger, transferring the precooled water to a discrete second heat exchanger of the ice bank type, discretely first cooling the water in the ice bank exchanger, routing a second portion of refrigerant through the ice bank, carbonating the water, dispensing the water after the final cooling, discretely controlling the refrigerant portions, and condensing refrigerant if needed by either heat exchanger.

A high efficiency method of cooling and dispensing cold carbonated water at a temperature just as close as possible to freezing has the steps of providing a warm water supply, providing a single source of condensed refrigerant, discretely precoollng the water to the range of 35–50 degrees F. (1–10 degrees C.), discretely routing a portion of the refrigerant into a first exchanger for the precooling, transferring precooled water to a discrete second heat exchanger, discretely routing a second portion of refrigerant to the second heat exchanger which is of the ice bank type, discretely final cooling the water down to just above freezing, and thereby providing cold water at just above freezing.

Apparatus for making, cooling, and dispensing cold carbonated water, has a refrigeration high side, a water conduit, first discrete precooling structure for precooling the water, second discrete final cooling structure of the ice bank type and downstream of the precool structure for final cooling of the water, a carbonator spaced upstream of the final cooler first refrigerant discharge branch refrigerant valve structure for the first cooler structure, a second refrigerant discharge branch with discrete refrigerant valve structure for the second cooler structure, and a control for starting and running the compressor when either cooling structure needs refrigerant.

Apparatus for making, cooling and dispensing cold carbonated water or beverage at a temperature just above freezing has a refrigerant high side, a water conduit, a discrete precooler, a discrete final cooler of the ice bank type, a first refrigerant discharge branch with a discrete refrigerant valve for the precooler, a second refrigerant discharge branch with a discrete refrigerant valve for the final cooler, discrete controls for the precooler and the final cooler, and a control to run the compressor if in the precooler or the final cooler needs refrigerant.

A post-mix carbonated beverage dispensing apparatus with an improved refrigeration system for supply of common refrigerant to two discrete heat exchangers has a precool heat exchanger for cooling water down only to an intermediate moderate temperature, a discrete ice bank type heat exchanger, a water conduit having an inlet connectible to a source and an outlet connectible to one or more dispensing valves, the water conduit extends sequentially firstly through the precool and then through a water bath of the ice bank heat exchanger, a carbonator in the water conduit upstream of the ice bank heat exchanger, and a syrup conduit extending from a source and through the ice bank heat exchanger to the dispensing valve, the carbonated water of intermediate temperature is reliably and accurately final cooled to very close to freezing by the ice bank heat exchanger.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

DESCRIPTION OF THE PREFERRED EMBODIMENT

Figure 1:
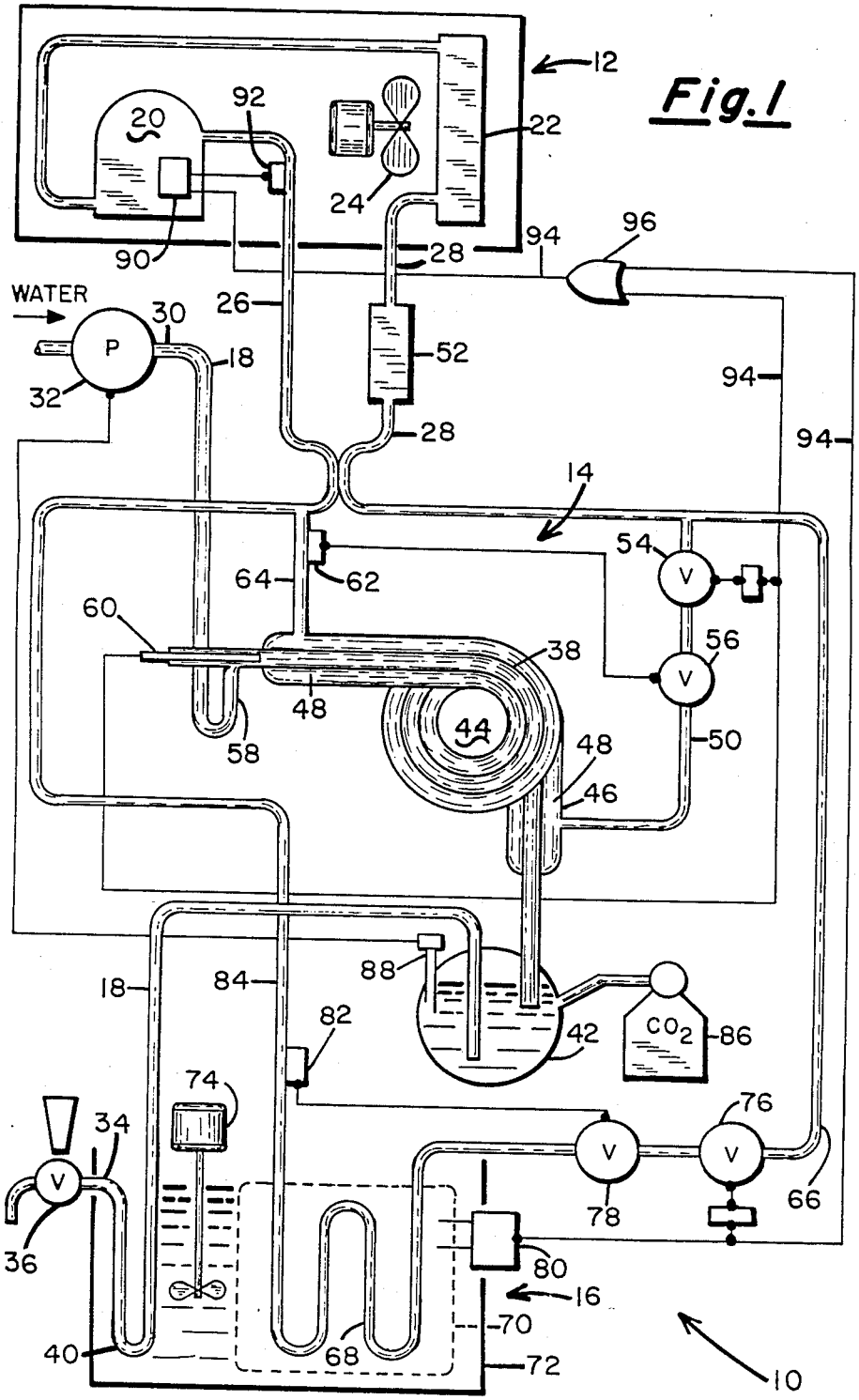
FIG. 1 is a schematic drawing of the water cooling and refrigeration system of the present invention.

According to the principles of the present invention, a dispensing apparatus for making, cooling and dispensing carbonated water is schematically shown in the drawing and is generally indicated by the numeral 10. The cooling apparatus has a refrigeration high side 12, a discrete first cooler which is hereafter referred to as the precooler 14, a discrete second cooler which is hereafter referred to as the final cooler 16, and a water conduit 18 extending sequentially through the spaced apart and discrete coolers 14, 16.

The refrigeration high side 12 is a conventional electromechanical refrigeration chassis with a compressor 20, a condenser coil 22, a condenser fan 24, a suction line 26, and a discharge line 28. The high side 12 may be alongside the coolers 14, 165 in a single structure, or the high side 12 may be a remote unit of the rooftop or behind and outside of the building types.

The water conduit 18 has an inlet end 30 adapted to be connected to a bulk supply of water, such as a municipal supply or private well, and to a water pressure booster pump 32. The water conduit 18 extends from the inlet 30 to an outlet 34 which is connectlble to at least one and usually more dispensing valve 36. The water conduit 18 extends firstly through an elongate length of heat exchanger tube 38 in the precooler 14, and then through a final cool coil 40 in the final cooler 16. The water conduit 18 extends through a carbonator 42 which is upstream of the final cooler 16, and in some cases downstream of the precooler 14, or in between the coolers 14, 16.

The precooler 14 is of a high capacity, extremely high efficiency type wherein the refrigerant gas is directly exposed to and placed in direct physical contact with the heat exchanger tube 38 of the water conduit 18. The precooler 14 has a tube-in-tube heat exchanger 44 wherein an elongate outer refrigerant tube 46 surrounds the water heat exchanger tube 38 and provides an elongate annular space 48 for precool refrigerant along the length of the heat exchange tube 38. The water heat exchanger tube 38 is preferably a helically twisted stainless steel tube with behind ribs that cause extremely high thermal contact and transfer. A first refrigerant discharge branch 50 extends from receiver 52 in the discharge line 28. The first branch 50 has a normally closed (NC) solenoid operated refrigerant supply valve 54, and a first thermal expansion refrigerant control valve 56 downstream of the supply valve 54. The heat exchanger 44 has a T-shaped precooler water inlet 58 as is shown and a thermal transducer well in the precooler water inlet 58. The water temperature transducer 60 extends into the water heat exchanger tube 38 and within the refrigerant tube 46. The transducer 60 is operatively connected to open and close the first refrigerant supply valve 54. A suction line temperature transducer 62 is on a discrete suction refrigerant outlet 64 from the precooler 14. The suction transducer 62 is operatively connected to open and close the refrigerant expansion valve 56 in response to the temperature of the refrigerant outlet 64.

A second discrete refrigerant branch 66 is connected to the discharge line 28 in parallel with the first branch 50. The second branch 66 connects the discharge line 28 to an evaporator coil 68 for freezing an ice bank 70 in the final cooler 16, which is an ice bank type cooler having a reservoir 72 filled with ice water which is circulated by an agitator motor 74. The second branch 66 has a discrete second normally closed (NC) refrigerant supply valve 76. An ice bank control 80 in the final cooler 16 determines if the ice bank 70 is of sufficient size or is too small. The ice bank control 80 is operatively connected to open and close the second branch refrigerant supply valve 76 in response to the size of the ice bank 70. A refrigerant temperature transducer 82 is on a discrete refrigerant outlet 84 from the ice bank coil 68. The transducer 82 is operatively connected to selectively open or close the second refrigerant control valve 78 in response to the temperature of the ice bank refrigerant outlet 84.

The carbonator 42 is supplied carbon dioxide gas at a regulated pressure from a gas bottle 86. A water level control 88 is operatively connected to turn the water pump 32 on and off to maintain a desired water level in the carbonator 32 under a propellant gas head of carbon dioxide gas in the carbonator 42.

The compressor 20 is provided with an on-off control 90 which is operatively connected to structure which will turn on the compressor 20 in response to either warm water in the precooler 14 or the size of the ice bank 70 in the final cooler 16.

A first structure for turning on the compressor 20 is a vacuum switch 92 in the suction line 26. If either of the supply valves 54, 76 is opened, refrigerant will be eventually sent into the suction line 26 and the rising refrigerant pressure will cause the vacuum switch 92 to turn on the compressor 20. When both supply valves 54, 76 are closed, a significant low pressure will be pulled in the suction line 28 and cause the vacuum switch 92 to turn off the compressor. The vacuum switch 92 will usually be used with a remote high side 12.

A second structure for turning the compressor 20 on and off is an optional control lead 94 which connects the water temperature transducer and the ice bank control 80 to an OR logic element 96 and thence to the compressor control 90. This type of control lead 94 will usually be used with an integral construction of the high side 12 and coolers 14, 16 as a single unit. If either the incoming water temperature transducer 60 calls for or requests refrigeration, or the ice bank control 68 calls for or requests refrigeration, the compressor 20 will be turned on simultaneously with the opening of either refrigerant supply valve 54, 76.

In the use and operation of the apparatus 10, and in the practice of the method of the present invention, warm water to be cooled and carbonated is provided via the inlet 30 to the water conduit 18. Water flowing into the precooler 14 warms up the incoming water transducer 60 which in turn opens the first refrigerant supply valve 54. A discrete first portion of condensed refrigerant from the received 52 discretely flows through the open refrigerant control valve 56 and into the refrigerant tube 46 and directly upon and over and along the water precool heat exchanger tube 38. The temperature of the refrigerant outlet 64 will gradually decrease and as the temperature sensed by the refrigerant outlet transducer 62 reaches a predetermined low temperature, the control vale 56 will be modulated to control or portion the quantity of refrigerant passing through the precooler 14 as a function of the refrigerant temperature of the outlet 64. Precooled water flows out of the precooler 14 at an intermediate moderate temperature in the range of 35–50 degrees F. (1–10 degrees C.). The range of variation can quite easily be controlled closed, for example 40–45 degrees F. (4.5–7.2 degrees C.). Regardless, the water temperature is sufficiently high enough above freezing so that there is absolutely no probability of a freeze up in the precooler 14. The water is simply not cooled close to freezing in the precooler 14 so there is no probability of freeze-up and failure. The water is not cooled to the serving temperature in the precooler 14. The majority of the water cooling is done in the precooler 14 and the precooled water temperature is brought to a temperature that is only as low as the control envelope will allow; the water is not further cooled. The precooling is done with the refrigerant directly upon the water tube 38 at a high temperature differential and is of the highest efficiency and highest cooling rate possible with a given compressor 20. The precooled water is transferred into the carbonator 42 at about 45 degrees F. (7 degrees C.) and is completely carbonated in the carbonator 42 at about 50 PSIG carbonation pressure under a head of carbon dioxide gas which easily gives a nominal carbonation in excess of 5 volumes. The carbonated water is then subsequently transferred while under the pneumatic carbonation pressure from the carbonator 42 and into the final cooling coil 40 wherein the previously carbonated water is final cooled to as close to freezing or 32 degrees F. (0 degrees C.) as is physically possible. A minor portion of the cooling is done in the final cooler 16 and again there is no posslbility of freeze up because of the ice bank 70 and the ice water bath being used between the final cooler evaporator 68 and the final cooling water coil 40. All cooling of carbonated water in the final cooler 16 is done by melting of ice from the ice bank 70.

When the final cooler 16 has done a quantity of final cooling, the ice bank 70 will have been reduced in physical size and the ice bank control 80 will sense that the ice bank 70 is too small. The ice bank control 80 will open the refrigerant supply valve 76 and a second portion of condensed refrigerant will flow from the receiver 52 through the supply valve 76 and the control valve 78 and through the ice bank coil 68. The transducer 82 monitors the temperature of the final cooler refrigerant outlet 84 and modulates the control valve 78 accordingly to provide an optimal and portioned flow of refrigerant.

It has been explained that either the precooler 14 or the final cooler 16, can effect turn on of the compressor 20. Both the precooler 14 and the final cooler 16 can also concurrently call for a request refrigeration and both refrigerant supply valves 54, 76 can be concurrently opened. In this circumstance the refrigerant control valves 56, 78 portion out the refrigerant in order to produce the greatest possible cumulative cooling of water.

The carbonated water being dispensed out of the dispensing valve 36 is usually about 10–15 degrees F. (5–8 degrees C.) colder than when it is carbonated; it is always colder. The carbonation pressure and therefore the propellant pressure is higher than the carbonation saturation pressure at the outlet of the final cooler 16 and at dispensing valve 36. This phenomena enables the apparatus 10 to very effectively be placed in a basement or lower level and to propel carbonated water to a dispensing valve 36 located remotely or at a higher elevation. The apparatus 10 is ideally suited for very high volume beverage retailers where the dispensing vale 36 is on an upper level, the precooler 14 and final cooler 16 are in a lower level, and the high side 12 is on the roof or outside of the building. The apparatus 10 is particularly effective with high inlet water temperatures.

Figure 2:
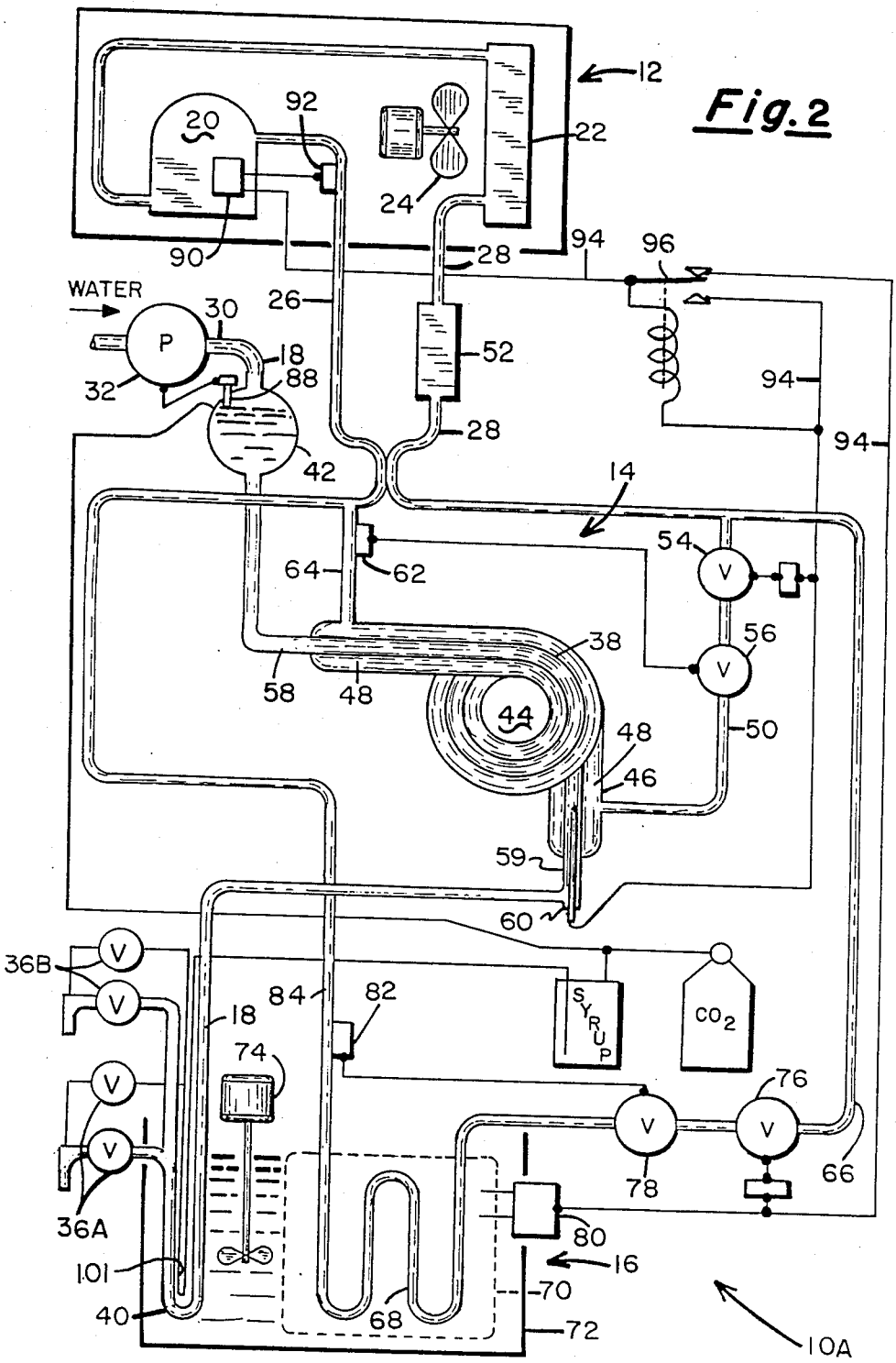
FIG. 2 is a similar schematic drawing of the preferred embodiment of the beverage dispenser of the present invention.

In the second and preferred embodiment of a postmix beverage dispensing apparatus 10A illustrated in FIG. 2, like components are given like reference numerals. One of the major improvements is that the carbonator 442 is located upstream of the precooler 14. This enables more consistent carbonation to be obtained compared to the arrangement shown in FIG. 1 as the water inlet temperature is usually more even than the precooler 14 outlet temperature, which very much depends on the water throughput rate. Furthermore because the water is warmer, higher CO2 pressures are required to obtain the necessary levels of absorption and carbonation, and this increases the propellant pressure on the carbonated water in the apparatus 10A to enhance propulsion of water through the system and the beverage dispensing valves 36A, 36B.

A second major improvement is the location of the water transducer 60 on the outlet 59 to the precooler 14 rather than on the inlet 58. This prevents the refrigeration system from fast cycling on and off thus lengthening its life in service. It also slows down the reaction time of the precooler when water starts to flow.

A third major improvement is the OR logic switch 96 which is now prioritized, so that it normally sits in the position shown in the drawing. In this position valve 76 is open and valve 54 is closed. The ice bank 70 is built up under the control of the thermostat 80. However, if transducer 60 senses warm water the switch 96 is operated to cut off current to valve 76, which closes, and to electrify valve 54 which opens to exclusively direct all of the refrigerant to the precooler coil 46.

Fourthly, the beverage concentrate may be supplied from a source 100 through a cooling coil 101 in the water bath 72 before being supplied to one of respective beverage dispensing valves 36A, 36B.

In the improved apparatus 10A, the logic of the prioritized OR switch 96 gives exclusive priority to all of the refrigerant to the precooler 14. The switch 96 is operative to shift all of the refrigerant to the precooler 14 during dispensing and while the compressor 20 is running without shut off of the compressor 20 and without any loss of compressor capacity. During freezing of the ice bank 70, the effective BTU output of the compressor 20 is about 7000 BTU/hour. During water flow through the precooler, heat extraction of up to 27,000 BTU has been measured with the same compressor 20. The BTU extraction increases with water flow rate and/or water inlet temperature. All syrup cooling is done in the final cooler 16.

This apparatus 10, 10A and method are extremely effective. Initial testing indicates that this apparatus 10, 10A and method will provide as much cold carbonated water and/or beverage as currently used units of four times the size of the apparatus 10. More specifically, this apparatus 10, 10A and method with a 50 pound ice bank 70 will provide more cold carbonated water and/or beverage than a 200 pound currently used ice bank unit of current state of the art construction. The apparatus 10, 10A and method of this invention are extremely useful in retailing environments wherein the dispensing may be done on any one or all of random draw during off times or slack business hours, heavy repetitive draw cycles during lunch, dinner and other peak business times, or continuous flow for production of gallonage of carbonated water. The apparatus 10, 10A absolutely excels with the high flow rates and high water temperatures found in the Southern U.S.A. during summer.

Although other advantages may be found and realized and various modifications may be suggested by those versed in the art, it should be understood that I wish to embody within the scope of the patent warranted hereon, all such embodiments as reasonably and properly come within the scope of my contribution to the art.

I claim as my invention:

1. A high efficiency method of making and dispensing cold carbonated water, comprising the steps of:

(a) providing a supply of potable water to be cooled, carbonated and dispensed;

(b) providing a single and common supply of condensed refrigerant gas;

(c) discretely precooling a flow of the water from a supply temperature down only to an intermediate reduced moderate temperature which is safely above freezing and above a desired serving temperature in a high thermal efficiency first and discrete precool heat exchanger, said intermediate temperature being always above 35 degrees F. (2 degrees C.);

(d) discretely routing a discrete first refrigerant portion from the single refrigerant supply over a metal heat transfer member which is in direct and intimate physical contact with both the first refrigerant portion and the water to be in precooled in said precool heat exchanger, during the step of precooling;

(e) transferring the precooled moderate temperature water from the precool heat exchanger to a discrete second and final heat exchanger of the ice bank type;

(f) completely carbonating the water prior to transferring it into the ice bank heat exchanger;

(g) discretely final cooling the precooled and previously completely carbonated water to a desired serving temperature just above and approaching as close as is possible to freezing by melting ice from the ice bank in the final heat exchanger;

(h) discretely routing a discrete second refrigerant portion from the single refrigerant supply through the final heat exchanger to build a reservoir of ice in the ice bank;

(i) dispensing the cold carbonated water from the final heat exchanger and after the final cooling step;

(j) discretely initiating and controlling said discrete individual said first and second portions of condensed refrigerant from the single supply to the precool and final heat exchangers respectively;

(k) condensing refrigerant gas for the single supply in response to need for refrigerant by either heat exchanger; and (l) in which the carbonation pressure exceeds the carbonation saturation pressure of the carbonated water after the step of final cooling, the full carbonation pressure being utilized as a propellant pressure for moving precooled water through said final cooling step and for dispensing cold carbonated water from the final cooler.

2. A method according to claim 1, in which the precooling step brings the water temperature down only into the range of 35–50 degrees F. (2–10 degrees C.).

3. A method according to claim 1, wherein the routing of the first refrigerant portion is turned on and off in response to the temperature of incoming water and in which the flow rate of the first refrigerant portion is portioned in response to the temperature of the first refrigerant portion upon its leaving the precool heat exchanger; wherein the routing of the second refrigerant portion is turned on and off in response to the physical size of the ice bank and in which the flow rate of the second refrigerant portion is portioned in response to the temperature of the second refrigerant portion upon its leaving the final heat exchanger; and wherein the condensing of refrigerant gas is started in response to either said incoming water temperature or said ice bank size.

4. A method according to claim 1, in which the step of carbonating is no later than immediately subsequent to the step of precooling.

5. An improved high efficiency method of making, carbonating, cooling and dispensing either a relatively high flow rate or a relatively low flow rate of chilled cold carbonated water at a generally constant temperature which is just above freezing regardless of flow rate, comprising the steps of:

(a) providing a supply of warm water to be cooled;

(b) providing a single supply of condensed refrigerant gas;

(c) discretely precooling the water only to a moderate intermediate temperature in the range of 35–50 degrees F. (2–10 degrees C.);

(d) discretely and selectively routing a discrete first portion of the refrigerant supply intimately over a metal heat exchange member in a precool heat exchanger and in direct contact with the water to be precooled, said routing being started and stopped in response to the temperature of incoming water and with the flow rate of refrigerant being portioned in response to the temperature of the refrigerant first portion as it is leaving the precool heat exchanger;

(e) transferring the precooled intermediate temperature water from the precool heat exchanger into a discrete second final exchanger of the ice bank type;

(f) discretely and selectively routing a discrete second portion of the refrigerant supply through the final heat exchanger to build up the ice in an ice bank supply, the routing of the second refrigerant portion being started and stopped in response to the size of the ice bank and the flow rate of the second refrigerant portion being portioned in response to the temperature of the refrigerant second portion as it is leaving the final heat exchanger;

(g) completely carbonating the water before the water is transferred to the final cooler;

(h) discretely final cooling the precooled and previously carbonated water down to a final and serving temperature just above and approaching freezing as close as is possible in the final heat exchanger by melting ice therein; and (i) providing the cold carbonated water at a serving temperature just above freezing out of the final heat exchanger in random repetitive cyclic, or continuous high or low flow under a carbon dioxide propellant pressure in excess of the carbonation saturation pressure of the final temperature.

6. The method of claim 5, including the further step of starting condensing of refrigerant gas in response to either the incoming water temperature or the size of the ice bank.

7. Apparatus for making and dispensing cold carbonated water, comprising:

(a) a refrigeration high side having a single compressor, a condenser, a suction line to the compressor, and a discharge line from the condenser;

(b) a water conduit having an inlet end connectible to a bulk water supply and an outlet end connectible to a plurality of dispensing valves;

(c) first and discrete precool means for precooling the water only to an intermediate and moderate temperature, said precool means having means for applying refrigerant in direct and high efficiency contact and thermal exchange relationship with a surface of said water conduit;

(d) second and discrete final cooling means for final cooling the water to a serving temperature, said final cooling means being an ice bank in thermal exchange relationship with the water conduit downstream of said first cooling means;

(e) a carbonator in said water conduit and spaced discretely upstream of said final cooling means, said carbonator having a carbonated water outlet leading to sald final cooling means;

(f) a first refrigerant discharge branch extending from the discharge line to the precool means, said first discharge branch having first refrigerant valve means for normally closing said first discharge branch and for portioning refrigerant therethrough;

(g) a second refrigerant discharge branch extending from the discharge line to the final cooling means, said second discharge branch having a second refrigerant valve means for normally closing said first discharge branch and for portioning refrigerant therethrough;

(h) first and second refrigerant suction branches to the suction line from the precool and final cooling means respectively; and (i) means for starting and running the compressor when either the precool or final cooling means requests refrigerant.

8. The apparatus of claim 7, including an electrical compressor start control connected to be responsive firstly to means for sensing the temperature of water in the precool means, and secondly to means for sensing the size of the ice bank in the final cooling means.

9. The apparatus of claim 7, in which said precool means has the water conduit inside of a tubular precool refrigerant evaporator.

10. The apparatus of claim 9, including a thermal transducer operatively connected to the first refrigerant valve means, said transducer extending into the water conduit and inside of the precool evaporator.

11. The apparatus of claim 10, wherein said transducer is connected in parallel to said first refrigerant valve means and to said compressor starting and running means.

12. The apparatus of claim 7, in which said first refrigerant valve means is operatively connected to a water temperature transducer within the precool means, said water temperature transducer being in heat exchange relationship with the water conduit which is extending through the precool means, and in which said first refrigerant valve means is also operatively connected to a discrete refrigerant thermal transducer on a discrete precool refrigerant outlet from the precool means.

13. The apparatus of claim 7, in which the second refrigerant valve means is operatively connected to an ice bank control in the final cooling means, and in which the second refrigerant valve means is operatively connected to a refrigerant temperature thermal transducer in heat exchange relationship with a discrete final cooling refrigeration outlet from the final cooling means.

14. High efficiency apparatus for making, cooling and dispensing cold carbonated water, comprising:

(a) a refrigeration high side having a single compressor, a condenser, a refrigerant suction line to the compressor, a refrigerant discharge line from the condenser, and a compressor control;

(b) a water conduit having an inlet end connectible to a bulk water supply, and an outlet end connectible to a plurality of dispensing valves;

(c) discrete precooler means for precooling the water only to an intermediate and moderate temperature, said precooling means having means for applying refrigerant in direct and high efficiency thermal exchange relationship with a surface of said water conduit;

(d) discrete final cooler means for final cooling the water from the intermediate and moderate temperatures to a final serving temperature, said final cooler means being an ice bank and ice water tank through which the water conduit extends downstream of the precooler means;

(e) a carbonator in said water conduit and spaced upstream of said final cooler means, said carbonator having a carbonated water outlet leading to said final cooler means;

(f) a first refrigerant discharge branch extending from the discharge line to the precooler means, said first branch having first refrigerant valve means for normally closing the final refrigerant branch and for portioning refrigerant therethrough;

(g) a second refrigerant discharge branch extending from the discharge line in parallel with the first branch, said second branch being extended to the final cooler and having second refrigerant valve means for normally closing the second branch and for portioning refrigerant therethrough;

(h) a precooler water thermal transducer within the precooler means and in heat exchange relationship with the water conduit, said precool transducer being operatively connected to said first refrigerant valve means for on-off control thereof;

(i) a precool refrigerant thermal transducer in heat exchange relationship with a discrete refrigeration outlet from the precooler means, said precool refrigerant transducer being operatively connected to said first refrigerant valve means for control of the portioning therethrough;

(j) an ice bank control in the final cooler and which is operatively connected to the second branch refrigerant valve means for on-off control thereof;

(k) a final cooler refrigerant thermal transducer in heat exchange relationship with a discrete refrigeration outlet line from the final cooler, said final cooler refrigerant transducer being operatively connected to the second branch refrigerant of the portioning valve means for control of the portioning of refrigerant therethrough; and (l) means connected to the compressor control for effecting running of the compressor if either the precooler or the final cooler requests refrigerant.

15. A high efficiency method of making and dispensing individual servings of cold carbonated post-mix beverage, comprising the steps of:

(a) providing a supply of potable diluent water to be cooled, carbonated and dispensed;

(b) providing a discrete supply of beverage concentrate to be cooled, dispensed, and mixed with the cold carbonated water;

(c) completely carbonating the water while it is at a temperature above a desired serving temperature;

(d) providing a single and common supply of condensed refrigerant gas;

(e) discretely precooling a flow of the carbonated water from an elevated supply temperature only to an intermediate reduced moderate temperature which is safely above freezing and above the desired serving temperature in a first and discrete precool heat exchanger;

(f) routing a discrete first refrigerant portion from the single refrigerant supply over a high thermal efficiency heat transfer member which is in direct and intimate physical contact with both the first refrigerant portion and the carbonated water to be in precooled in said precool heat exchanger, during the step of precooling;

(g) transferring the precooled moderate temperature carbonated water from the precool heat exchanger to a discrete second and final heat exchanger of the ice bank type;

(h) discretely and reliably and accurately final cooling the precooled carbonated water from the intermediate temperature down to a desired serving temperature just above and approaching as close as is possible to freezing by melting ice from an ice bank final heat exchanger;

(i) discretely routing a discrete second refrigerant portion from the single refrigerant supply through the final heat exchanger to build a reservoir of ice in the ice bank;

(j) cooling the concentrate to the serving temperature with the ice bank of the final heat exchanger;

(k) dispensing the cold carbonated water and cold syrup from the final heat exchanger after the final cooling step and mixing the dispensed cold carbonated water and syrup to form the beverage;

(l) discretely initiating and portioning said discrete individual said first and second portions of condensed refrigerant from the single supply to the precool and final heat exchangers respectively;

(m) condensing refrigerant gas for the single supply in response to request for refrigerant by either heat exchanger;

(n) maintaining a carbonation pressure which exceeds the carbonation saturation pressure of the carbonated water after the step of precooling, the full carbonation pressure being utilized as a propellant pressure for moving precooled carbonated water subsequently through said final cooling step; and (o) giving the precool heat exchanger priority to use of the single supply of condensed refrigerant gas.

16. A method according to claim 15, in which the precooling step brings the carbonated water temperature down only into the range of 35–50 degrees F. (2–10 degrees C.).

17. A method according to claim 15, in which the first refrigerant portion is routed and portioned from the common source in response to the discrete temperature of a discrete refrigeration outlet from the precool heat exchanger.

18. A method according to claim 15, in which the second refrigerant portion is routed and portioned from the common source in response to the discrete temperature of a discrete refrigerant outlet from an evaporator coil in the ice bank of the final heat exchanger.

19. A method according to claim 15, wherein the routing of the first refrigerant portion is turned on and off in response to the temperature of carbonated water outgoing from the precool heat exchanger, and in which the flow rate of the first refrigerant portion is portioned in response to the temperature of the first refrigerant portion upon its leaving the precool heat exchanger;

wherein the routing of the second refrigerant portion is turned on and off in response to the physical size of the ice bank and in which the flow rate of the second refrigerant portion is portioned in response to the temperature of the second refrigerant portion upon its leaving the final heat exchanger; and wherein the condensing of refrigerant gas is started in response to either of the outgoing water temperature or the ice bank size.

20. The method of claim 15, in which the final cooling of the carbonated water and all of the cooling of the concentrate is done solely by the ice of the final cooler.

21. The method of claim 15, in which the precool heat exchanger is given exclusive priority for sole use of all of the single refrigerant supply.

22. The method of claim 15, including the step of normally connecting a refrigerant compressor for said single refrigerant supply operatively to means for sensing the size of said ice bank.

23. The method of claim 15, including the step of carbonating upstream of an inlet to the precool heat exchanger.

24. A high efficiency method of making, cooling and dispensing one or more individual servings at either relatively high flow or relatively low flow cold carbonated water at a temperature just above freezing, comprising the steps of:

(a) providing a supply of warm water to be cooled;

(b) carbonating the warm water;

(c) providing a single supply of condensed refrigerant gas;

(d) discretely precooling the warm carbonated water only to a moderate intermediate temperature in the range of 35–50 degrees F. (2–10 degrees C.);

(e) discretely and selectively routing a discrete first refrigerant portion from the refrigerant supply into a discrete precool heat exchanger and intimately over a precool heat exchanger member in direct and intimate physical contact with the water to be precooled, said routing being started and stopped in response to the temperature of water at the precool member and with the flow rate of refrigerant being portioned in response to the temperature of the refrigerant first portion as it is leaving the precool heat exchanger;

(f) transferring the precooled carbonated water from the precool heat exchanger into a discrete final heat exchanger of the ice bank type;

(g) discretely and selectively routing a discrete second refrigerant portion from the refrigerant supply through the final heat exchanger to build up ice in an ice bank supply, the routing of the second refrigerant portion being started and stopped in response to the size of the ice bank and the flow rate of the second refrigerant portion being portioned in response to the temperature of the refrigerant second portion as it is leaving the final heat exchanger;

(h) discretely final cooling the precooled carbonated water down to a final serving temperature just above and approaching freezing in the final heat exchanger;

(i) dispensing the cold carbonated water out of the final heat exchanger at a temperature just above freezing in random, repetitive cyclic or continuous flow in a relatively low flow or a relatively high flow while under a carbon dioxide propellant pressure in excess of the carbonation saturation pressure of the final temperature;

(j) providing a majority of the cooling in and with the precooler; and (k) giving the precool heat exchanger priority to the single refrigerant supply.

25. The method of claim 24, including the further step of starting the condensing of refrigerant gas in response to either the incoming water temperature as sensed at one end of the precooler heat exchanger, or the size of the ice bank as sensed in the final cooler.

26. The method of claim 24, including the step of giving exclusive priority to all of the single refrigerant supply to the precool heat exchanger.

27. The method of claim 26, including the step of shifting access to the refrigerant supply while the compressor is running during dispensing, from the final heat exchanger to the precool heat exchanger.

28. A post-mix beverage apparatus for making and dispensing individual servings of cold carbonated beverage, comprising:

(a) a refrigeration high side having a single compressor, a condenser, a suction line to the compressor, and a discharge line from the condenser;

(b) a diluent water conduit having an inlet end connectible to a bulk water supply and an outlet end connectible to a plurality of dispensing valves;

(c) at least one syrup conduit connectible to a source of beverage syrup and to one of the dispensing valves;

(d) first and discrete precool means for precooling the water only to an intermediate moderate temperature, said precool means having high thermal efficiency means for applying refrigerant in direct thermal exchange relationship wlth a surface of said water conduit;

(e) second and discrete final cooling means in said water conduit and downstream of said precool means for final cooling the water and for discretely cooling the syrup, said final cooling means being an ice bank in thermal exchange relationship with the syrup conduit and with the water conduit downstream of said precooling means;

(g) a first refrigerant discharge branch extending from the discharge line to the precool means, said first discharge branch having first refrigerant valve means for normally closing the first discharge branch and for discretely portioning refrigerant through said precool means;

(h) a second refrigerant discharge branch extending from the discharge line to the final cooling means, said second discharge branch having a second refrigerant valve means for normally closing said second discharge branch and for portioning refrigerant through said final cooling means;

(g) first and second refrigerant suction branches to the suction line from the precooling and final cooling means respectively;

(j) means for starting and running the compressor when either the precool or final cooling means requests refrigerant; and (k) priority means for giving the precool means priority to the refrigerant.

29. The apparatus of claim 28, in which said carbonator is upstream of the precool means and is thermally discrete from either of the precool means or the final cooling means.

30. The apparatus of claim 28, in which said priority means has logic for giving the precool means exclusive priority to refrigerant from the high side.

31. The apparatus of claim 30, wherein said priority means has logic for giving exclusive priority for all of the refrigerant from the high side solely to the precool means.

32. The apparatus of claim 31, wherein said priority means is operatively connected for shifting access to the refrigerant from the final cooling means to the precool means during dispensing and operation of the compressor.

33. The apparatus of claim 29, including a water temperature transducer at a downstream end of the precool means and which is operatively connected to the high side and the first refrigerant valve means, for sensing temperature of precooled carbonated water and controlling the high side in response thereto.

34. A high efficiency post-mix beverage apparatus for making, cooling and dispensing individual servings of cold carbonated beverage comprising:

(a) a refrigeration high side having a single compressor, a condenser, a refrigerant suction line to the compressor, a refrigerant discharge line from the condenser, and a compressor control;

(b) a water conduit having an inlet end connectible to a bulk water supply, and an outlet end connectible to a plurality of beverage dispensing valves;

(c) at least one syrup conduit connectible to a source of beverage syrup and to one of the dispensing valves;

(d) a discrete precooler for precooling only the water down to only an intermediate moderate temperature, said precooler having high thermal efficiency means for applying refrigerant in direct thermal exchange relationship with a surface of said water conduit;

(e) a discrete final cooler for final cooling the water down from the moderate temperature to a serving temperature near freezing and for cooling the syrup, said final cooler being an ice bank and ice water tank through which the water conduit extends downstream of the precooler means and through which the syrup conduit extends;

(f) a carbonator in said water conduit and spaced upstream of said precooler and said final cooler;

(g) a first refrigerant discharge branch extending from the discharge line to the precooler, said first branch having first refrigerant valve means for normally closing the first branch and for portioning refrigerant to the precooler;

(h) a second refrigerant discharge branch extending from the discharge line in parallel with the first branch, said second branch being extended to the final cooler and having second refrigerant valve means for normally closing the second branch and for portioning refrigerant to the final cooler;

(i) a water temperature thermal transducer at the precooler and in heat exchange relationship with the water conduit and which is operatively connected to said first refrigerant valve means;

(j) a precool refrigerant thermal transducer in heat exchange relationship with a discrete refrigeration outlet from the precooler and which is also operatively connected to said first refrigerant valve means;

(k) an ice bank control connected into the final cooler and which is operatively connected to the second refrigerant valve means;

(l) a final cooler refrigerant thermal transducer in heat exchange relationship with a discrete refrigeration outlet line from the final cooler and which is operatively connected to the second refrigerant valve means;

(m) means connected to the compressor control for effecting running of the compressor if either the precooler or the final cooler requests refrigerant; and (n) Priority means for giving the precooler priority to refrigerant from the high side.

35. The apparatus of claim 34, in which said water temperature transducer is at the downstream end of the precooler, and the priority means includes logic for giving the precooler exclusive priority to all of the refrigerant from the high side and for shifting access to the refrigerant from the final cooler to the precooler during dispensing and while the compressor is running.

36. A post-mix carbonated beverage dispensing apparatus including:

(a) an improved single refrigeration system for supply of condensed refrigerant in parallel to two discrete heat exchangers, said heat exchangers comprising:

(1) a precool heat exchanger for cooling water down only to an intermediate and moderate temperature which is above a desired serving temperature; and (2) a discrete ice bank type heat exchanger;

(b) a water conduit having an inlet connectible to a source of water and an outlet connectible to one or more beverage dispensing valves; said water conduit extending through first the precool heat exchanger and then subsequently through a heat exchanger immersed in a water bath in thermal contact with an ice bank of the ice bank exchanger;

(c) a carbonator in said water conduit and spaced upstream of said ice bank heat exchanger; and (d) a syrup conduit having an inlet connectible to a source of syrup and an outlet connected to said dispensing valves, said syrup conduit being extended through said water bath, and in which (e) the carbonated water is accurately final cooled from the moderate to a serving temperature very close to freezing in the ice bank heat exchanger before being dispensed and mixed with the cooled syrup.

37. The beverage dispensing apparatus of claim 36, wherein said carboantor is upstream of and spaced from said precool heat exchanger.

38. The beverage dispensing apparatus of claim 37, wherein refrigerant for said precool heat exchanger is subject to the controlling output of a water temperature transducer at an outlet of said precool heat exchanger.

39. The beverage dispensing apparatus of claim 36, including refrigerant priority means for giving priority to said precool heat exchanger.

40. The beverage dispensing apparatus of claim 39, wherein said priority means has logic for giving exclusive priority to all of the refrigerant to said precool heat exchanger.

41. The beverage dispensing apparatus of claim 36, including (1) first discrete refrigerant valve means fluidly connectible to said condensed refrigerant and said precool heat exchanger for discretely normally precluding flow of said refrigerant to and for discretely selectively portioning said refrigerant to said precool heat exchanger;

(2) second discrete refrigerant valve means fluidly connectible to said condensed refrigerant and said ice bank heat exchanger for discretely normally precluding flow of said refrigerant to and for discretely selectively portioning said refrigerant to said ice bank heat exchanger; and (3) priority means favoring said first refrigerant valve means over said second refrigerant valve means.

* * * * *